US010709182B1

(12) United States Patent
Healy et al.

(10) Patent No.: US 10,709,182 B1
(45) Date of Patent: Jul. 14, 2020

(54) GARMENT WITH DRAPING AND ACCESS FOR MEDICAL TREATMENT, DIAGNOSIS AND CARE

(71) Applicants: Thomas Henry Healy, Asheville, NC (US); Samantha Claire Kyle-Healy, Asheville, NC (US)

(72) Inventors: Thomas Henry Healy, Asheville, NC (US); Samantha Claire Kyle-Healy, Asheville, NC (US)

( * ) Notice: Subject to any disclaimer, the term of this patent is extended or adjusted under 35 U.S.C. 154(b) by 184 days.

(21) Appl. No.: 15/635,471

(22) Filed: Jun. 28, 2017

(51) Int. Cl.
*A41D 13/00* (2006.01)
*A41D 13/12* (2006.01)
*A41D 27/10* (2006.01)

(52) U.S. Cl.
CPC ..... *A41D 13/129* (2013.01); *A41D 13/1236* (2013.01); *A41D 13/1263* (2013.01); *A41D 27/10* (2013.01); *A41D 13/12* (2013.01); *A41D 13/1209* (2013.01); *A41D 2400/44* (2013.01)

(58) Field of Classification Search
CPC ..... A41D 13/129; A41D 13/1236; A41D 13/1263; A41D 27/10; A41D 13/1209; A41D 13/12; A41D 2400/44
See application file for complete search history.

(56) References Cited

U.S. PATENT DOCUMENTS 1,998,051 A * 4/1935 Gerber ..... A41D 13/1236 2/114
2,212,719 A * 8/1940 Prouty ..... A41D 13/1209 2/93
2,686,914 A * 8/1954 Weiser ..... A41D 13/1236 2/105
2,768,383 A * 10/1956 De Witt ..... A41D 13/1236 2/114
3,276,036 A * 10/1966 Cater ..... A41D 13/1236 2/114
3,464,063 A * 9/1969 Hoegerman ..... A41D 13/1236 2/114
4,205,398 A * 6/1980 Blume ..... A41D 13/1236 2/114
4,434,511 A * 3/1984 Weiser ..... A41D 13/129 2/114
4,637,863 A * 1/1987 Perichon ..... C25B 3/04 205/428
4,759,083 A * 7/1988 Belcher ..... A41D 13/1236 2/114
4,864,657 A * 9/1989 Lake ..... A41D 13/1236 2/114
4,920,578 A * 5/1990 Janzen ..... A41D 13/1236 2/114
5,062,159 A * 11/1991 Jakub ..... A41D 13/1236 2/105
5,133,086 A * 7/1992 Truitt ..... A41D 13/1236 2/105
5,184,351 A * 2/1993 Benstock ..... A41D 13/1236 2/105

(Continued)

*Primary Examiner* — Amy R Weisberg

(57) ABSTRACT

A garment of general loose fit is provided surrounding the back and torso with sides extended to overlapping front panels and multiple points and/or regions of coupling to provide segmental and/or incremental access to regions of the body of the wearer for visual diagnostic access and for ease of access for application of treatment materials; data and treatment conduits and lines; and functions such as nursing by a mother.

1 Claim, 4 Drawing Sheets

(56) References Cited

U.S. PATENT DOCUMENTS 5,440,763 A * 8/1995 Shah ..... A41D 13/1236 2/105
5,794,207 A * 8/1998 Walker ..... G06Q 10/02 705/77
5,897,620 A * 4/1999 Walker ..... G06Q 10/02 705/5
6,012,166 A * 1/2000 Burbidge ..... A41D 13/1236 2/114
6,032,288 A * 3/2000 Simone ..... A41D 13/1245 2/114
6,272,685 B1 * 8/2001 Kumar ..... A41D 13/1236 2/114
6,510,418 B1 * 1/2003 Case ..... G06Q 20/00 705/26.8
6,553,346 B1 * 4/2003 Walker ..... G06Q 10/02 705/24
7,073,204 B1 * 7/2006 Boyles ..... A41D 13/1236 2/114
7,188,176 B1 * 3/2007 Nedderman ..... G06F 16/958 709/227
9,521,871 B2 * 12/2016 Bolla ..... A41D 13/1245
2006/0253953 A1 * 11/2006 Williams ..... A41D 13/1236 2/69
2007/0130668 A1 * 6/2007 Berman ..... A41D 13/1236 2/114
2007/0271675 A1 * 11/2007 Eraca ..... A41D 1/215 2/104
2008/0000006 A1 * 1/2008 Ochoa ..... A41D 13/1236 2/114
2008/0230075 A1 * 9/2008 Tasezen ..... A41D 13/1236 128/874
2010/0095424 A1 * 4/2010 Grgich ..... A41D 13/1236 2/104
2012/0078190 A1 * 3/2012 Austin ..... A41D 13/1236 604/174
2012/0151658 A1 * 6/2012 Von Furstenberg ..... A41D 13/1236 2/114
2013/0276202 A1 * 10/2013 Forbes ..... A41D 13/1236 2/114
2015/0033439 A1 * 2/2015 Dimotsantos ..... A41D 13/1236 2/114
2015/0313297 A1 * 11/2015 Ward ..... A41D 13/1254 2/114
2016/0278456 A1 * 9/2016 Monardo ..... A41D 13/1236

* cited by examiner

GARMENT WITH DRAPING AND ACCESS FOR MEDICAL TREATMENT, DIAGNOSIS AND CARE

CROSS-REFERENCE TO RELATED APPLICATION

U.S. PPA No. 62/355,610; Conf. #9878

FEDERALLY SPONSORED RESEARCH

None

SEQUENCE LISTING OR PROGRAM

None

BACKGROUND

Field of Discovery

It is common for places of treatment, including hospitals and day clinics, to provide garments during the treatment stay or the diagnostic visit. A gown-like garment is common whatever else may be provided in the way of pajamas or other shirts and pants. The provision of consistent, uniform garments provides, among other things, a safe, clean beginning garment, replacement for personal garments which would otherwise risk staining, contamination, or damage during procedures and care; and uniform identity for patients who are the object of attention. Design of such garments has ranged from mimicry of common clothing configurations to other designs that do not provide consistent coverage for modesty or comfort, such as the notorious open-backed gown with edges only barely joined by cloth ties.

In addition to clothing for ongoing wear that is washable, most institutions have expensive and waste-generating disposable items that cover a patient only briefly during exams or treatment. It is not uncommon for a patient to shuttle from a uniform of daily wear to a disposable uniform of temporary coverage to complete a simple exam and back to the uniform of daily wear; sometimes more than once in a day.

Up until the time of this application there has been a strong mandate toward better providing for the personal needs of patients within the complex, and often intimidating, technical settings of medicine. The clothing and draping provided to a patient falls within this mandate.

Despite the expressed concerns for both access and modesty which are addressed by inventiveness, it is well known that common gowns, such as those tied or snapped at rear opening edges, continue in use without deployment of any prior inventions cited. The common apparel lacks modesty and adaptability for sequential access to certain body regions.

Despite multiple examples of overlapping panels, partial opening sections of panels, and various couplings on sections of the garments, the mandate for more effective invention persists.

Prior Art

Despite innumerable attempts to solve the problem, no medical or personal satisfactory solution has been made; rather, all the proposed solutions are variations on the same old theme. Indeed, there are so many failures that they shall be addressed by examples.

From 1940 through the 1960's, designs brought some new configurations of gown elements for localized access and improved versatility of body coverage. U.S. Pat. No. 2,768,383 provides an access to one side, and U.S. Pat. No. 2,686,914 maintains an access in the rear center and subsequent patents have varied the location or methods of closure for openings.

The 1980's brought a rapid succession of new designs. For example, a gynecologic examination has a very traditional sequence of coverage for modesty during the procedure, and U.S. Pat. No. 4,205,398 focused on allowing a gown to serve as the draping of a patient during that exam. U.S. Pat. No. 4,759,083 also provides various partial access sequences for upper body examination. U.S. Pat. Nos. 4,637,863 and 4,864,657 provide overlapping panels to a variable degree and provide rear opening with little versatility for frontward opening.

U.S. Pat. No. 5,133,086 combines both rearward full length opening and methods for partial upper body access which are reminiscent of the sequences in U.S. Pat. No. 4,759,083. In more recent years modesty continues to be a concern as, U.S. Pat. No. 6,032,288 builds what amounts to an outer robe over a traditional exam gown with rear opening, to provide modesty while reducing medical accessibility and ease of entry.

In the extreme, for some religious observance, there are burka-styled outfits providing maximum coverage at the cost of medical access.

In short, innumerable attempts to solve the problem have been made with little or no actual success.

Priceline's U.S. Pat. Nos. 5,794,207; 5,897,620; 6,085,169; 6,510,418; 6,553,346 and 7,188,176 are for business models but none relates to the business model of providing garments, linens, etc. by paid messaging on them.

SUMMARY

The experience of medical care is a succession of visits by multiple providers, each intruding upon the space of the patient, and each requiring a region of intrusion extracted from all the other regions that deserve to be maintained as covered and undisturbed on behalf of the patient. Further, medical care, as well as assisted living, commonly require partial or total disrobing from one's street clothes, robing in some sort of examination gown, draping, and then disrobing from that garment and re-robing in one's street clothing. The present examination gowns, despite innumerable efforts to make one that works, actually provide very poor medical access and often require additional draping. They are usually cold, ill-fitting and humiliating to the patient. The draping costs money, commonly generates waste, and often calls for a nurse or other person in addition to the doctor for modesty's sake.

The described discovery provides a versatile garment that is personally secure for modesty, and comfort, and which also makes experiences of examination and treatment more efficient. The inventive configurations provide new points of coupling and patterns to accomplish new shapes of fabric to be operated by both patient and by staff. The operation of these configurations allows diverse medical care at multiple sites of interest and for repeated visits.

It can diminish usage of temporary, often disposable, drapes and clothing which are often deployed in haste and then turned to waste.

It also keeps a maximum number of operational coverages immediately available by embodiment in a regularly worn outer garment as generic as a gown, jacket or robe but as specialized as the inventive forms provided.

It is a further advantage that the following listed body regions, among others, are provided with access that is exclusive exposure, meaning that the adjacent regions, some of which are also named on the same following list, may remain covered while the each named region is exposed. Some regions of interest serviced by this discovery are: The upper shoulders and neck beyond the scope of a mere collar, the upper chest, the mid chest (upper chest and lower regions remaining draped), the abdomen, the lateral torso (and axilla) (for either left or right side), the back, the legs for both or either sides, arms for viewing and procedural access, the combinations of any adjacent regions such as B, C and D, J.

DRAWINGS—REFERENCE NUMERALS

1 Garment
2 Right Front Panel
3 Left Front Panel
4 Rear Panel
5 Right Sleeve
6 Left Sleeve
7 Right Pocket
8 Left Pocket
9 Human Outline
10 Communication Area
11 Left Panel Far-Upper Coupling Site
12 Right Sleeve Upper Coupling Site
13 Left Panel Far-Lower Coupling Site
14 Right Panel Near Coupling Site
15 Right Sleeve Lower Coupling Site
16 Right Panel Far-Lower Coupling Site
17 Left Panel Near Coupling Site
18 Left Sleeve Lower Coupling Site
19 Right Panel Far-Upper Coupling Site
20 Left Sleeve Upper Coupling Site
21 Right Sleeve Anterior Wrist Coupling Site
22 Right Sleeve Posterior Wrist Coupling Site
23 Right Sleeve Wrist Coupling Site
24 Left Sleeve Anterior Wrist Coupling Site
25 Left Sleeve Posterior Wrist Coupling Site
26 Left Sleeve Wrist Coupling Site
27 Left Panel Between-Legs Coupling Site
28 Right Panel Between-Legs Coupling Site
29 Rear Between-Legs Coupling Site
30 Between-Legs Coupling
31 Bib
32 Bib Upper-Right Coupling Site
33 Bib Upper-Left Coupling Site
34 Bib Lower-Right Coupling Site
35 Bib Lower-Left Coupling Site
36 Bib Location
37 Right Upper Coupling
38 Right Lower Coupling
39 Left Upper Coupling
40 Left Lower Coupling
41 Right Sleeve-Side-Front Aperture
42 Left Sleeve-Side-Front Aperture
43 Neck Opening
44 Right Sleeve Wrist Opening
45 Left Sleeve Wrist Opening
46 Bottom Opening
47 Right Leg Opening
48 Left Leg Opening
49 Right Sleeve Wrist Coupling
50 Left Sleeve Wrist Coupling
51 Left Neck-Clavicle Opening
52 Neck-Upper Chest Opening
53 Neck-Chest Opening
54 Chest-Upper Abdomen Opening
55 Chest-Abdomen Opening
56 Abdominal Opening
57 Folded Edge
58 Folded Edge
59 Folded Edge
60 Contralateral Upper Free Edge of Right Front Panel
61 Contralateral Lower Free Edge of Right Front Panel
62 Ipsilateral Lower Free Edge of Right Front Panel
63 Ipsilateral Upper Free Edge of Right Front Panel
64 Proximal Free Edge of Right Sleeve
65 Contralateral Upper Free Edge of Left Front Panel
66 Contralateral Lower Free Edge of Left Front Panel
67 Ipsilateral Lower Free Edge of Left Front Panel
68 Ipsilateral Upper Free Edge of Left Front Panel
69 Proximal Free Edge of Left Sleeve
70 Right Lateral Torso Access
71 Left Lateral Torso Access
72 Folds
73 Right Neck-Clavicle Opening
74 Slot
75 End of Slot
76 Slot Edge
77 Point

DRAWINGS—FIGURES

Figure 3:
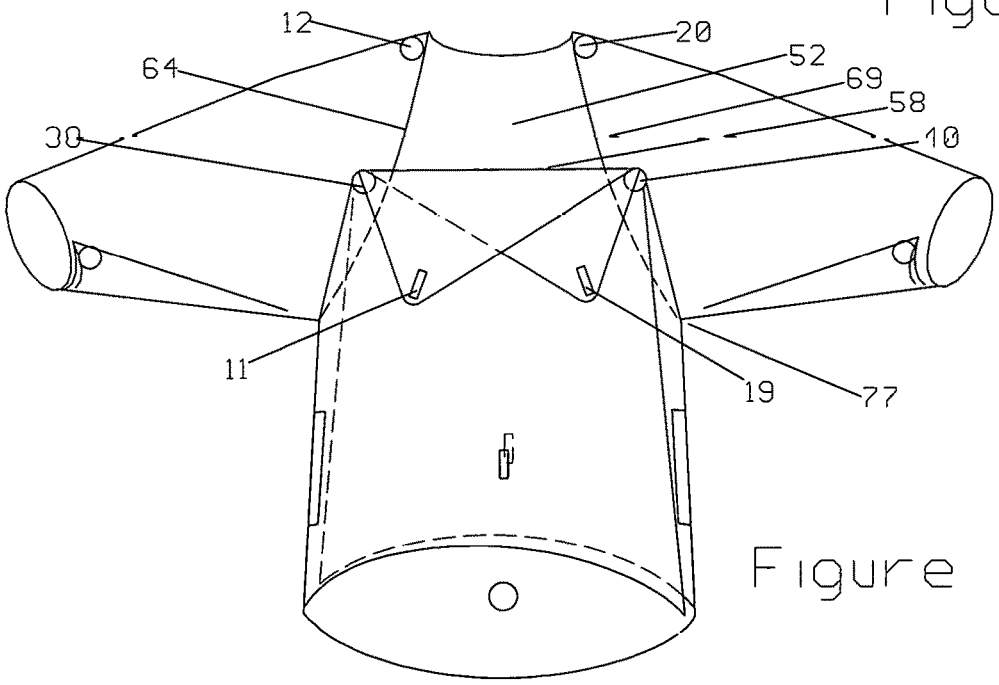

FIG. 3 view with 2 panels partially opened further exposing region B.

Figure 4:
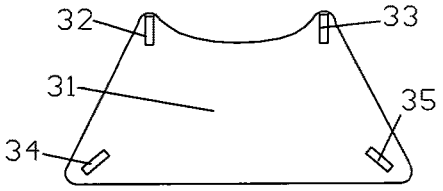

FIG. 4 supplemental bib panel for nursing and other modesty

Figure 5:
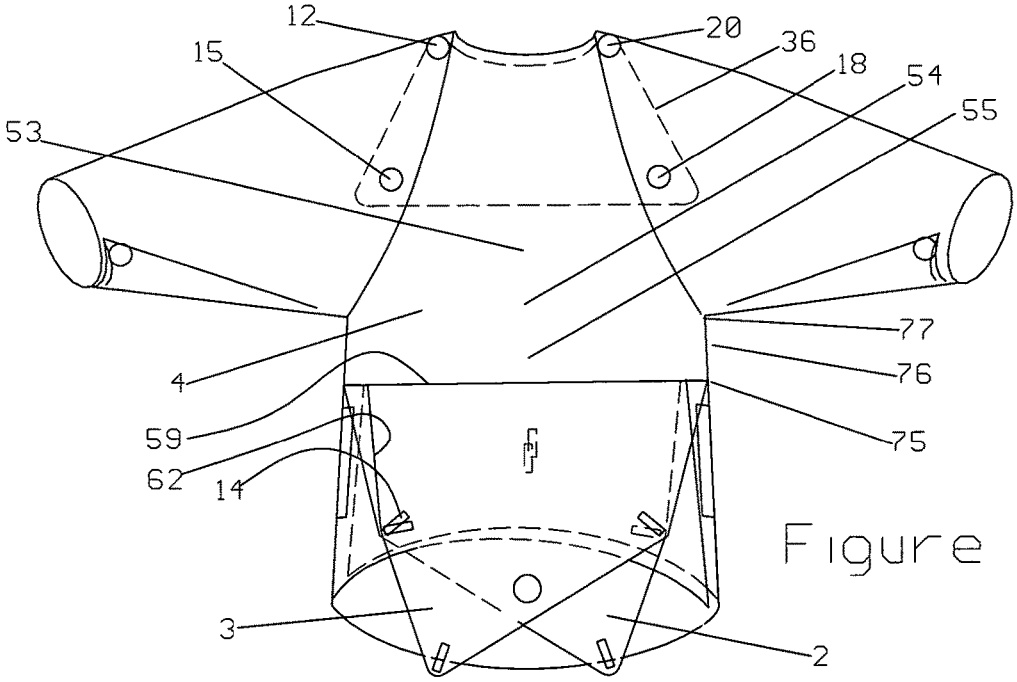

FIG. 5 view with 2 panels more fully opened exposing regions A, B, C and D

Figure 6:
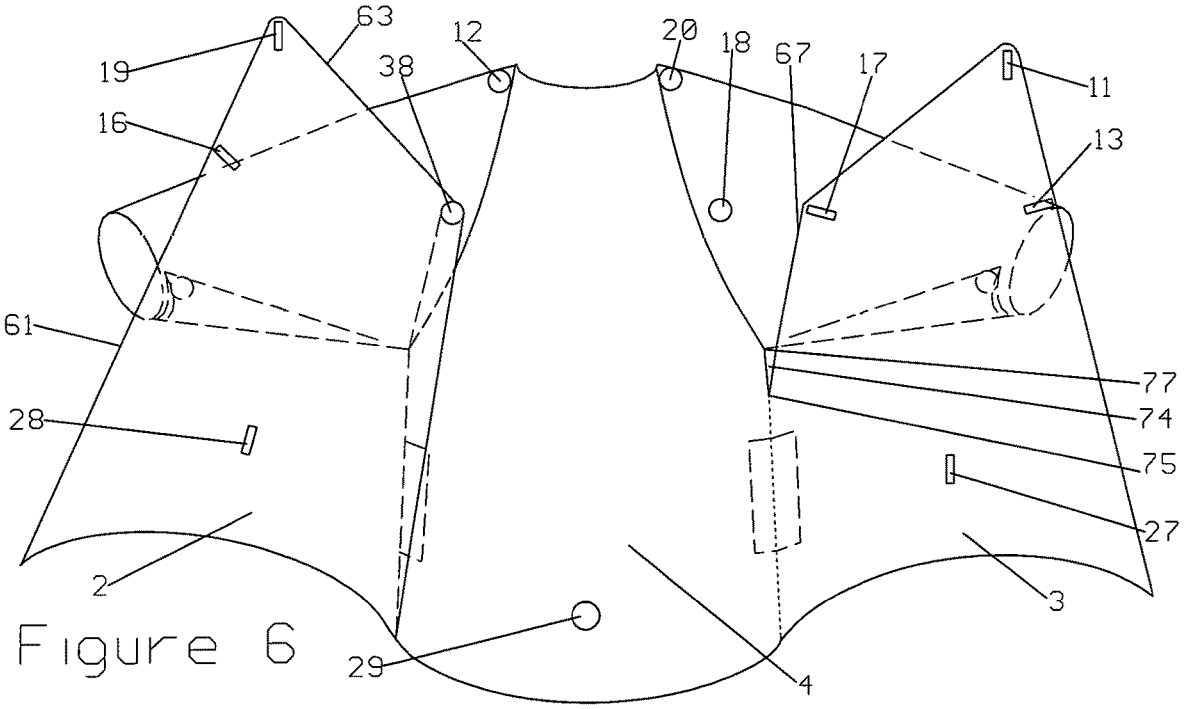

FIG. 6 view with 2 panels fully opened

Figure 7:
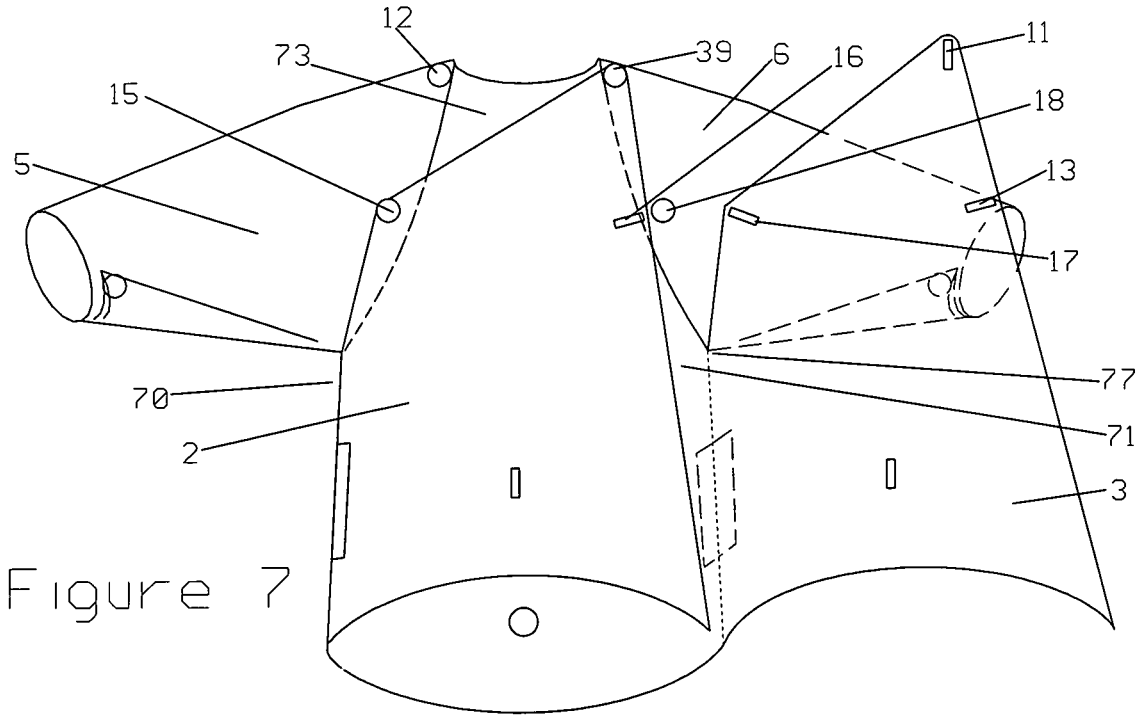

FIG. 7 view with only one panel fully opened

Figure 8:
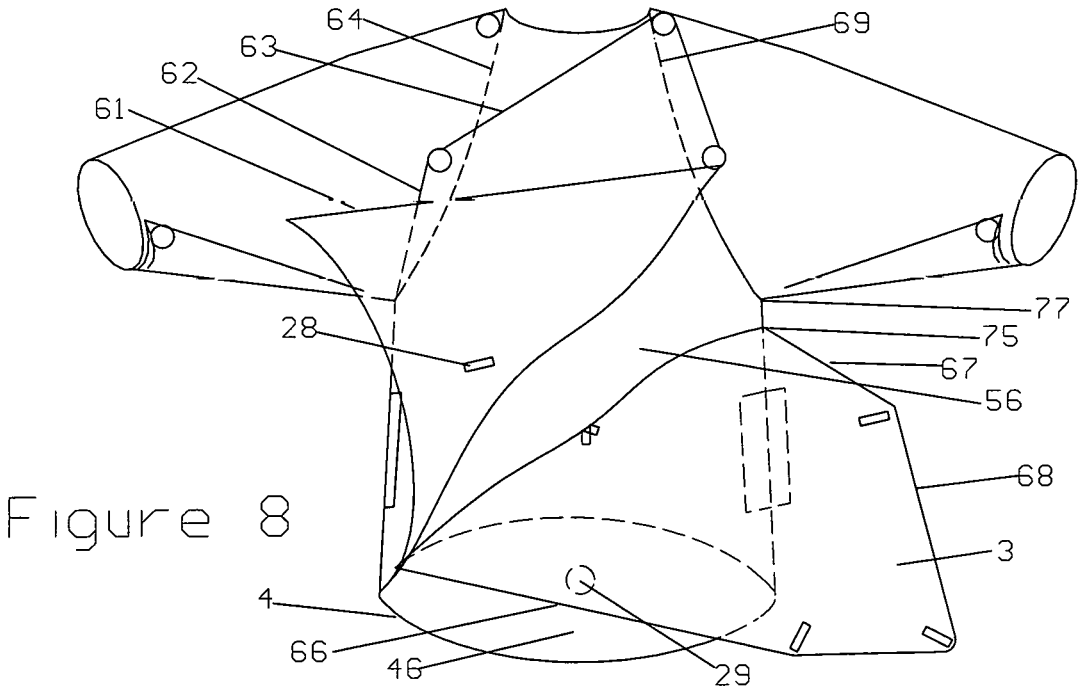

FIG. 8 view with 2 panels partially opened diagonally

DETAILED DESCRIPTION

Figure 1:
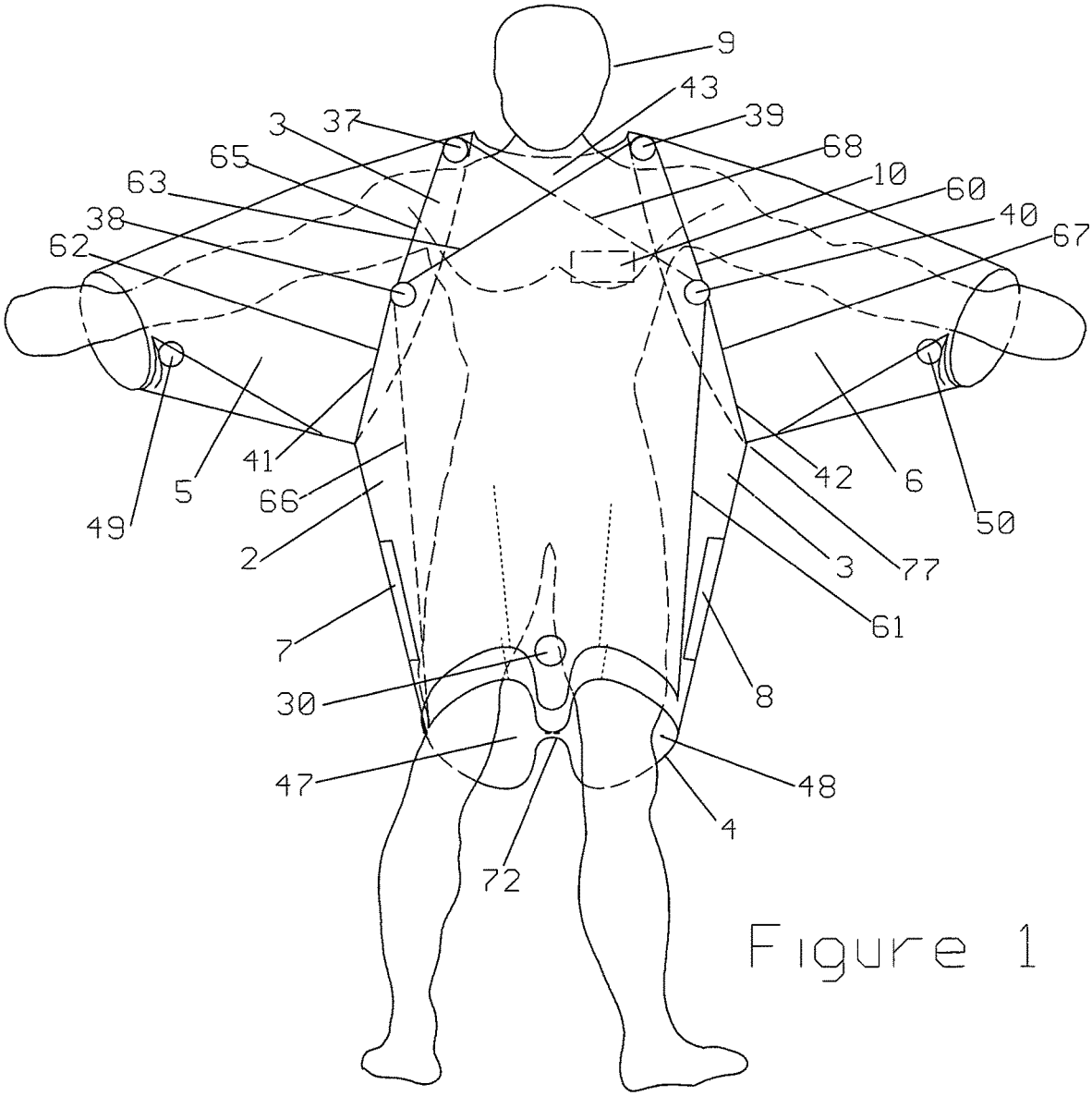
FIG. 1 depicts a front view of the garment surrounding a human outline.

FIG. 1 depicts the discovery surrounding a human figure by a gown or robe-like clothing providing full modesty. The gown is shown with right front panel 2 closed and outermost over the left front panel 3, which is only partly showing at the two sites where numeral 3 touches. The overlapping front panels 2 and 3 are described by their edges defined in the positions of closure.: right panel 2 has: contralateral upper free edge 60, contralateral lower free edge 61, ipsilateral lower free edge 62 and ipsilateral upper free edge 63; and the free edges of left panel 3 are: contralateral upper free edge 65, contralateral lower free edge 66, ipsilateral lower free edge 67 and ipsilateral upper free edge 68. The ample roominess of each sleeve 5 and 6 are shown pleated; narrowed by couplings 49 and 50 to be further shown in open configuration in later figures. The lengthy bottom portion of the gown may be gathered inward between the legs by coupling 30. It is notable that for patients requiring more back than front medical access, the discovery may be worn backwards with the panels 2 and 3 closing in the back region.

Message area 10 shown by dashed line can be of any size and shape, and in any location and contain any message. It is arbitrarily shown in a relatively small region oriented frontward on panel 3, but in some cases a large area such as the entire region 4 between the two panels 2 and 3 could be occupied by prominent artwork or written messages. The message area may include including logos or messages which credit or even blatantly advertise of corporate entities involved in service, products, information, or support of health care.

A single coupling site comprises a coupling part and a region of coupling, even if that coupling part is the region of joining.

The couplings may be of various forms or configurations to accomplish their joining function and in some cases may appear identical or complimentary and often the two parts may be mounted in either orientation on a region, for example, hook and loop parts may reside on either of the regions that each joins. Therefore when two regions of the garment are separated, the separated coupler parts which comprise a coupling site when joined may still be referred to with a common identifier number even when both parts are shown simultaneously in a given figure.

Although the depiction of coupler part 11 and coupler part 12 would appear to convey button and a button hole as one coupling means, the concept of a coupler part is intended to be any item which may mate to the other part at a coupling site.

Any single coupling is comprised of at least two coupling sites which are retained with the respective regions of garment that are joined at that coupling. For purposes of this specification, a numerical citation of a coupling depicts the joining of respective coupling sites which are established on each region of garment and coupling sites are cited numerically when these site are separated from an accomplished coupling. For fastening to be accomplished, the participating coupling sites may have dissimilar coupler parts which may be mounted in either orientation on a region. For example hook and loop parts may reside on either of the regions that are to be joined, or the orientation of button and buttonhole may be switched between two regions. In other cases a fastener coupling site may be nearly identical when mounted on two coupling sites on regions, for example, fabric ties Although the depiction of coupling site 11 and coupling site 12 would appear to convey button and a button hole as one coupling means, the concept of a coupling site is intended to be any item which may mate to the other part at a coupling.

A given coupler site such as 15 may also have variance within a garment region so that it might be fixed for coupler part 11 on one joining region but might have multiple sites for coupler part 12 on its other joined region. For example, a coupling may comprise a clip removably or permanently affixed at a one coupling site which grasps the fabric as another at its mating coupling site, thus the fabric comprises a coupler part which is variable in location within a region. This one to many coupling can also be changed to a many to many coupling when the grasping clip is freed from each region and has two grasping parts; such a dual grasping part may benefit from being tethered loosely to avoid being separated from the garment.

FIG. 7 is discussed next to promptly demonstrate the fully retracted left panel 3 and the fully closed right panel 2. Panel 2 is anchored to sleeve 5 at a near coupling site 15, and to the opposing sleeve which is the left sleeve 6 at its far upper mating coupling site 20 forming left upper coupling 3939.

The uncoupled left panel 3 shows all mating coupling sites most clearly, and these comprise left panel near mating coupling site 17, left panel far upper mating coupling site 11, and left panel far lower mating coupling site 13. It is again noted that the right panel far lower mating coupling site 16 is not joined to the left sleeve lower coupling site 18. It can be also noted that that coupling site 18 serves as the shared anchor point for both mating coupling sites 16 and 17 which reside on opposing panels and may also serve as a coupling site for bib 31. The inner panel in this depiction is the right panel 2 to be anchored first by far lower mating coupling 16. Accordingly the right sleeve lower coupling site 15 also serves the same purpose as a shared coupling site for the two panels on the opposing side.

By this choice of sequential overlapping panels, FIG. 7 depicts access to the left lateral torso area 71 (shown by an arrow since the lateral surface is not visible in the frontal projected drawing) while keeping the frontal body covered by means of the right panel 2. This is a common form of exclusive draped access for aiding left chest procedures and drains and also examination of the heart apex region which is oriented towards the left lateral chest. With the coupling site 18 uncoupled it can be appreciated that the left arm sleeve 6 may be retracted to expose the left axillary area which is the area of concern for drains and incisions post-operative to a left unilateral breast and node dissections.

A mirrored reversal of the opposing panels 2 and 3 will result in a frontal draped access for the right torso and right axilla. This reversed orientation of panels is shown in FIG. 1, where the left frontal panel 3 is innermost rather than outermost as it is in FIG. 7.

It should be noted that a sufficiently roomy sleeve and gown could allow a patient to pull the left arm inward and out from left sleeve 6 after which the body can be turned within the remaining gown enclosure with the patient in what is known as a right lateral decubitus posture. In such posture, the back region of the patient would be exposed to the left sided opening of the gown when the gown is configured according to the depiction of FIG. 7. This is a method of use of the gown for draping a patient while accessing the back in a recumbent posture and the same sequential method may be applied to a standing examination. As a means of draping for examination of the back, this differs from the method of full removal of the gown by staff and re-application backwards on a patient.

Figure 2:
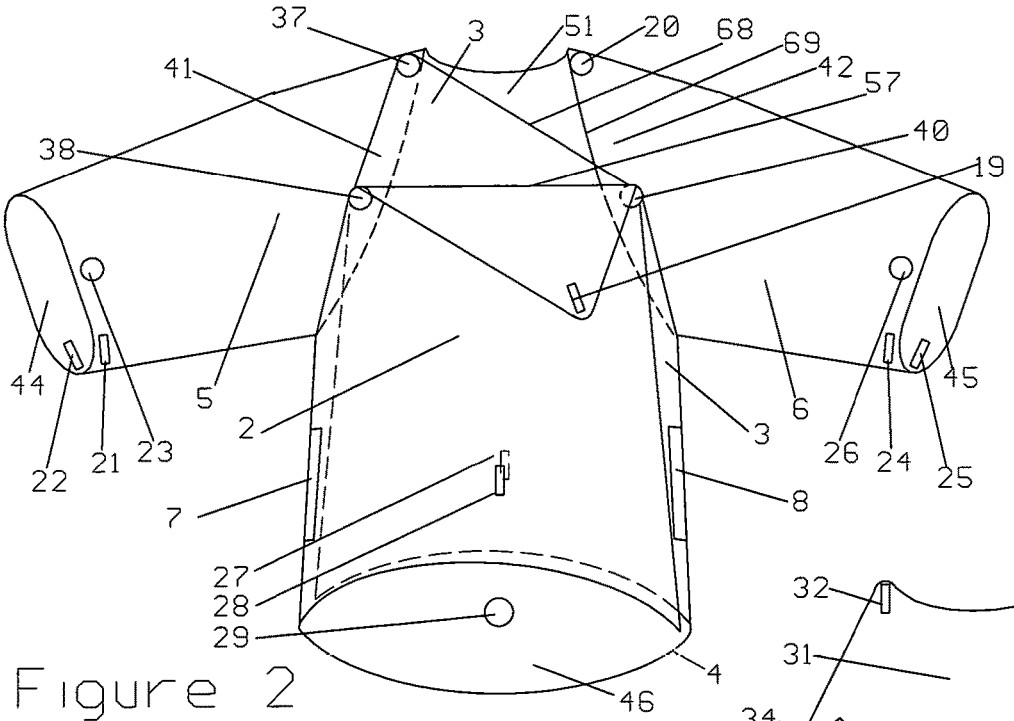
FIG. 2 depicts a front view with one panel partially opened partially exposing the upper chest region B.

Moving on to FIG. 2 a form of minimal regional access is demonstrated which exposes region A described above which is a part of the neck and shoulder area larger than a typical collar and in this case biased to the leftward region of A. In this case the right frontal panel 2 is depicted outermost, as in FIG. 1 and as opposed to FIG. 7. Only one of its mating fastener coupling sites, right panel far upper mating fastener coupling site 19, is shown free from left sleeve upper fastener coupling site 20 which creates a minimal upper chest exposure biased toward the left side which is often common for partial heart auscultation and certain IV access such as subclavian venous lines.

Each roomy sleeve is provided means to be gathered at the lower arm and is discussed for the left arm where left sleeve wrist coupling site 26 can be shared by both an anterior left sleeve wrist mating coupling site 24 and a posterior sleeve wrist mating coupling site 25. This is preferred for a neater dual pleat neatness however a single anchored mating fastener coupling site may accomplish a single the pleat.

Both arm sleeves are shown uncoupled, and it can be appreciated that a roomy sleeve can be rolled up to a high level for peripheral venous access inspection and intravenous solution bags can be readily passed entirely through the sleeve to be hung from above, without having intravenous lines exiting through the hand opening of the same sleeve. It can be appreciated that the left arm sleeve proximal free edge 69 can also be retracted laterally to expose large portions of the left shoulder and axilla. To carry out such retraction it is of course necessary to apply traction to remaining parts of the gown panels which constitute a weight and are coupled to the shared left lower coupling site 18 by the two separate mating couplings sites 16 and 17 which have been previously described for each panel 2 and 3.

The between-legs coupling 30 is shown uncoupled and each frontal panel 2 and 3 are free to be moved upward for examination of perineal regions of the body. In this figure the unattached mating coupling sites 27 and 28, as provided in each panel, and share the coupling site 29 as a common anchor, and when coupled, form coupling 30 as shown in FIG. 1.

It must be appreciated that the joining of coupling site 29 to both panels (as depicted in FIG. 1) is not necessarily intended only for modesty and the convenience of ambulation to gather the loose drapings of the lower gown. This central anchor, coupling 30, may remain attached during examination to function as a positive limit keeping a portion of both front panels from being pulled upward beyond the perineal crotch.

A sequence of events is described here without an exact depiction, but is fully understandable by the written description and the depicted elements. A supine patient with gown closed by coupling 30 between the legs draws both knees upward in flexion. The entire lower gown is pulled up to the point of resistance with the perineal crotch by the coupled panels. In this maneuver only the most lower portions of those front panels and also of rear panel 4 remain as folds which are shown in the region of arrow 72, FIG. 1. These folds of fabric which are below the coupling provide some draping for modesty at the perineal region. The predominance of both legs would be are exposed with a minimum of chance of exposing the perineal region, whether the knees remain drawn upward or the legs are returned to supine extension. Furthermore with the positive coupled limit being reached, then selected portions of the lower hem of either panel can be more confidently folded upward to access anterior thigh, lateral thigh, or even inguinal areas without exposing the more central anatomy of the perineum. It must be appreciated that this discovery worn by a patient is provided positive anchorage during progressively more proximal examination up the leg, and this is not found in unanchored drapes, often light weight and disposable, which may slide away during motion of an examined appendage or motion of other regions of the patient's body.

FIG. 3 depicts upper chest exposure Region 52, with both frontal panels 2 and 3 freed from their respective uppermost coupling sites, which comprises left sleeve upper coupling site 20 serving right panel far-upper mating coupling site 19 and right sleeve upper coupling site 12 serving left panel far-upper mating coupling 11. Each panel remains anchored to each sleeve by both a near and a far mating coupling site already described above, using FIG. 7; the exposed area bounded below by folded edge 58. It can be noted again that the proximal free edges 64, 69 of each sleeve can be further retracted to access each shoulder to some extent, according to traction upon the lower portions of the gown which remain attached to sleeves through coupling sites 18 and 15.

FIG. 4 shows a panel of cloth 31 with multiple mating coupling sites for attachment at respective coupling sites which would be joined at the following anchor points 32 to 12; 33 to 20; 34 to 15 and 35 to 18. It should be noted that the panel which can function as a replaceable bib is reversible. The panel 31 also functions as a modesty panel for breast feeding as depicted in FIG. 5, in which case it might be coupled only by upper couplings 12 and 20. By sharing the coupling sites 12 and 20 on each sleeve it is possible to anchor the pertinent mating coupling sites of both the modesty nursing panel and also both each front panel at the coupling sites 19 and 11. the same time. The deployment of the bib can also allow for examination of region D, the abdomen with breast and chest region C covered (depending on the size deployed.)

In FIG. 5 it should be noted that the location of the bib 31 nursing panel is depicted as a dashed line outline, because its presence is optional. With the bib panel 31 attached, the lower chest region, Region 53, and some upper abdomen 54 is exclusively exposed, bounded below by folded edge 59. By removing the panel outline, FIG. 5 depicts a complete exposure of contiguous areas A, B, C, D which neck, upper chest and lower chest and some abdominal area. described above, Regions 51, 52, 53, that might otherwise be exposed separately and exclusively, and these areas are upper chest and lower chest and some abdominal area. The extent of abdominal exposure depends on how far downward on the clothing a slot is extended to separate the rear panel 4 from any frontal panel such as shown for the left frontal panel 3 separated by a slot edge 76 terminating at point 77. When the left panel 3 is closed, a slot 74 is formed and this is depicted in FIG. 6. This slot is an optional embodiment which allows more separation for a front panel in relation to the rear panel 4 and when such a slot is deployed it may be preferred to provide an additional anchor to close slot 74 and such an anchor would be placed at the approximate location of point 77. The level of choice for a point 75 could be chosen differently for opposite sides of a given gown, so that no slot or differing slots might be provided on one side compared to another side. FIG. 5 depicts having a slot on each side and FIG. 6 depicts having the slot 74 on only the left side.

FIG. 8 shows a partial abdominal access with both chest and the lower abdomen excluded from exposure. Left panel 3 is shown uncoupled to any sleeve, but right panel 2 remains fully coupled to provide adjustable draping coverage of the chest region and is freed from between-leg coupling site 29 at mating coupling site 28. Left panel 3 serves as adjustable draping for the lower abdominal region and depends primarily first upon simple gravity for positioning upon a supine patient placement, however the deployment of between-legs coupling site 29 to mating coupling site 27 alone provides a more secure anchoring of draping on of the excluded region.

The discovery has been depicted with coupling between points of fabric by means of buttons and respective mating buttonholes and other sets of joined objects can be invoked and deployed to accomplish the same geometry of anchorage. These other sets may include for example snaps, rigid hooks and eyelets, patches of adherent location such as hook and loop fasteners, hooks which engage the primary fabric of the clothing, and mated ties.

Although a benefit of the discovery is the reduction of usage of disposables, paper and other disposable gowns can deploy the geometry of the discovery with anchorage as simple as adhesive patches with the appropriate amount of repeatable stick and release, as well as with draping clamps and other means.

Each front panel deploys both an ipsilateral and a contralateral coupling in relation to sleeve material. This is preferred, yet it is possible to achieve a less versatile version of the discovery by sacrificing an ipsilateral coupling of either panel by joining it permanently to the ipsilateral sleeve at either lower sleeve coupling site 18 or 23. Such a devaluation of the discovery would remove some of the uses for exclusive regional access and exposure, but such partial design would nonetheless take from the principles of discovery taught in the gown preferred here.

It is notable that for patients requiring more back than front medical access, the discovery may be applied backwards with the panels 2 and 3 closing in the back region. Using the configurations described for frontal partial access, it can be appreciated that medical staff may deploy draping for selected regions of the posterior surface of a patient.

Finally the principle of advertising deployed upon a gown worn by an ordinary patient is disclosed here as an inventive business relationship to draw more parties into funding the cost of comfort and dignity in an improved apparel for a patient that has medical and economic advantages to the caregivers as well. The principle of advertising on hospital clothing accomplishes an significant paradigm of relationships to a product and to persons and institutions. This novel business model becomes all the more feasible by defining the relationships that are coordinated to define a usable message on clothing that would not otherwise be there since, for example, we know that gowns are a bland commodity. As evidence, even the printing "Property of XYZ Hospital" is more like prison garb, but almost certainly there are hospitals that have some gentler logo already deployed so it would be obvious to promote a corporation or a hospital by a logo.

Promoting an integrated message, chosen after counsel, is more like providing a treatment modality. Then the wearer assisting in the design of the gown so that becomes a personal fixture, akin to Linus's blanket, becomes an additional therapy and a very personal form of "public relations".

The concept of mementos, keepsakes, souvenirs, travel badges, "service ribbons," artistic license and expression are all more related to motivational healing. The sponsor, whether it be the hospital or some outside corporation, become more of a footnote that is fortunate to be held in reflected light of the primary message.

This is really merging "therapeutic service," identity, promotion, and more, with a product. Executing this is an art form the same as "marketing" or schmoozing is an art form. It might have to be written to capture some of the salient milestones in the treatment experience, for example: admission for elective admissions, as emergencies don't get such thoroughness; recovery and debriefing when stable; convalescence; discharge; follow-up visits; and finally the possible hospice and memorial uses of the same clothing. Such art has analogies to uniforms and uniform symbol language; non-uniform and non-uniform symbols; role of choice with initial affiliation with any message; and the role of subsequent self-design.

The therapeutic artist consultant is viewed as a member of the therapeutic team and the analogy to personal decoration: gaining a new identity, change of personality and appearance through clothing, broadcasting status as patient, survivor, recovered, improved, adapted, or returnee is established.

There is value to note that there are articles in popular literature about, for example, wigs and cancer treatment success.

The "Give Away Gown" concept using corporate largesse and hunger for advertising may be painted for claims by itself but it might more likely be a novelty that could die if it is just selling unsupervised ad space the way billboards are sold. Possibly the only way in which corporations would want an enduring relationship to art on clothing would be if they "believe" that some patients love it and become bonded to the name recognition of the corporation. If the art is just to look at then that's one thing to counter the tedium of an institutional setting but if the art is a "commissioned exercise," much like tattoos on a skin which can be shed, then it is much more of a guided experience that would be associated with the moods, perceptions, learning; becoming healing that is experienced.

Regarding the product: Gowns have heretofore been a necessary cost of operating health care in a uniform manner and this has tended to make clothing a commodity with great incentive to cheapen the product that ultimately must serve a patient in a difficult experience. The provision of advertising allows for part of that cost to be defrayed and to identify a benefactor or sponsor of an improved gown.

Extending the product is another feature of advertising, because the message of advertising may be 90% focused on beauty and art which aids the patient experience or 90% focused on written word that convey positive quotes that are health related and beneficial. The actual identity or logo of a sponsor may be 10% or less of that advertising space such that the sponsor is truly not earning attention without sufficient good to all concerned. There may be sponsors completely anonymous on the advertised space of the gown, but identified only remotely in other promotional recognition.

Regarding the person: The messages and art provide on a gown are a form of personalization at least to the extent that a patient may chose the messages and content in addition to choosing a gown size or color. This may add some cost in inventory, but the gown as invented and the method of using the gown to convey meanings is an extension of the ways to provide for the patient.

Regarding the Institutions: Hospitals often own the gowns which are inventoried, cleaned and managed for their patients. Hospitals may prefer to advertise themselves side by side with other sponsors and to still defray cost of gowns by obtaining outside sponsors. The gown is enabled to become an extension of the identity of the institution by providing messages, just as printed literature provides a message for a patient. For this reason some gowns may go home with a given patient because of personal attachment to the experience and the clothing. Hospitals already send home disposable plastic ware which cannot be reused for a new patient. The gown is entirely different, when hospitals have washing protocols in place. The reason for this gown possibly going home with a patient is because the gown can more nearly become associated with a person, because family visitors witness that person in the gown and messages and art can be chosen to reinforce that ownership of the object. Just as a cast can be worn and autographed, so can a gown if the proper colorfast pigments are applied. A cast is usually eventually disposed, in part because it is not washable. An autographed gown would more likely be carried into a future wearing and washing if provided the correct writing implements and areas of fabric suitable for signing.

The business method of providing an improved gown and a more personalized gown including messages with outside sponsors as a funding means for a former commodity is a novel means of business. The concept moves a former dull and inadequate product to a means of communication between an institution and the person served; particularly in health care which must serve up many messages. The provision of such message space can bring sponsorship. A company providing an improved gown according to the discovery and the business method has the opportunity to no longer view the gown to be a completed product because the evolution of messages and art and the mix of sponsoring businesses is ever changing as are the opportunities therewith.

OPERATION

In operation one uses this garment as one would any garment that one might wear over the shoulders such as a jacket, dress, robe, coat, shirt, vest or cape, with all the benefits of those garments for wearability in public; with the addition of patient or assisted living gown use, donned from the front or back, enjoying full modesty and superior medical access and integral draping by making unique combinations of opening and re-fastening of the various parts and closures in accordance with the detailed explanations throughout the Figures and other sections herein.

CONCLUSION, RAMIFICATIONS AND SCOPE

Accordingly, the reader will see that we have provided a unique, novel and practical garment suitable for wear in a multitude of situations and most appropriate when medical or nursing care is involved.

The present discovery, an improved garment, provides complete modesty, superior medical access, and integral draping, the design elements of which may be used in whole or in part in many situations.

While the above description contains many specificities, these should not be construed as limitations on the scope of any embodiment, but as exemplifications of the presently preferred embodiment thereof. Many other ramifications and variations and combinations of design elements are possible within the teachings of the various embodiments. For example, the like combinations of construction and closure may be applied to trousers, other garments, and many other constructions.

Although the discussion herein addresses the medical and other care uses of the new garment, this clothing means is not limited in scope and applies as well, in whole or in part, to such diverse purposes as maternity, nursing, and even battlefield, animal, and other specialized wear.

Thus, the scope of the discovery should be determined by the appended claims and their legal equivalents, and not by the examples given.

The invention claimed is:

1. A garment comprising:

Overlapping left and right front panels;

a rear panel;

a left and a right sleeve joined to the rear panel; and a plurality of couplings including:

a first coupling located at a point on an upper region of the left sleeve;

a second coupling located at a point at a lower sleeve region of the left sleeve;

a third coupling located at a point on an upper region of the right sleeve;

a fourth coupling located at a point at a lower sleeve region of the right sleeve;

a fifth, sixth, and a seventh coupling located on the left front panel;

a eighth, ninth, and a tenth coupling located on the right front panel;

wherein the first and the second couplings are configured to be coupled with the eighth and the ninth couplings, respectively, such that the right front panel is coupled with the left sleeve;

wherein the fourth coupling is configured to be coupled with the tenth coupling such that the right front panel is coupled with the right sleeve;

wherein the third and the fourth couplings are configured to be coupled with the fifth and the sixth couplings, respectively, such that the left front panel is coupled with the right sleeve;

wherein the second coupling is configured to be coupled with the seventh coupling such that the left front panel is coupled with the left sleeve wherein the garment is configured to provide full modesty coverage when the plurality of couplings are coupled and allowing access to a region of the wearer when some of the plurality of couplings are uncoupled while maintaining modest coverage of the wearer.

* * * * *